United States Patent [19]

DeVera

[11] Patent Number: 4,674,787

[45] Date of Patent: Jun. 23, 1987

[54] PROTECTIVE COVER FOR SNOW SKI BINDINGS WITH CARRYING POUCH

[76] Inventor: Freddie DeVera, 44106 Beech Ave., #2, Lancaster, Calif. 93534

[21] Appl. No.: 785,609

[22] Filed: Oct. 8, 1985

[51] Int. Cl.[4] ..... A63C 11/00; B65B 11/00

[52] U.S. Cl. ..... 294/147; 150/52 R; 224/917; 280/814

[58] Field of Search ..... 280/814; 150/52 R; 224/917; 294/147

[56] References Cited

U.S. PATENT DOCUMENTS

| | | | |
|---|---|---|---|
| 3,851,689 | 12/1974 | Kohls | 280/814 |
| 3,889,861 | 6/1975 | Fihn | 280/814 X |
| 4,055,287 | 10/1977 | Champenois, Jr. | 280/814 X |
| 4,261,493 | 4/1981 | Newman | 280/814 X |
| 4,377,306 | 3/1983 | Abatecola | 280/814 X |

FOREIGN PATENT DOCUMENTS

| | | | |
|---|---|---|---|
| 131040 | 12/1932 | Austria | 280/814 |
| 1299186 | 6/1962 | France | 280/814 |
| 83251 | 1/1954 | Norway | 280/814 |
| 240478 | 4/1946 | Switzerland | 280/814 |

*Primary Examiner*—Nancy A. Swisher
*Attorney, Agent, or Firm*—Howard A. Kenyon

[57] ABSTRACT

A cover for protecting snow ski bindings from the elements is described. The protective cover encases two (2) bindings simultaneously with two (2) layers of flexible material, the inner layer being waterproof. Fastener straps are attached to the outer layer to hold the cover in place. This waterproof encasement protects the bindings when the skis are being transported or are placed in storage. The ski poles are attached to the outside cover by suitable fastener straps.

An additional strap, attached to the protective cover, forms a sling to permit the skier to conveniently transport the skis to and from the slopes. When the protective cover is not in use, it is folded and stored in a pouch. The pouch when connected to the additional strap may be worn around the waist by the skier until the protective cover is again needed. A cloth red cross is also stored in the pouch which may be attached to the cover by suitable fastening means. The cover may then be attached to upright skis placed in the snow and the red cross thereby displaying a signal for help in an emergency.

17 Claims, 7 Drawing Figures

FIG. 3
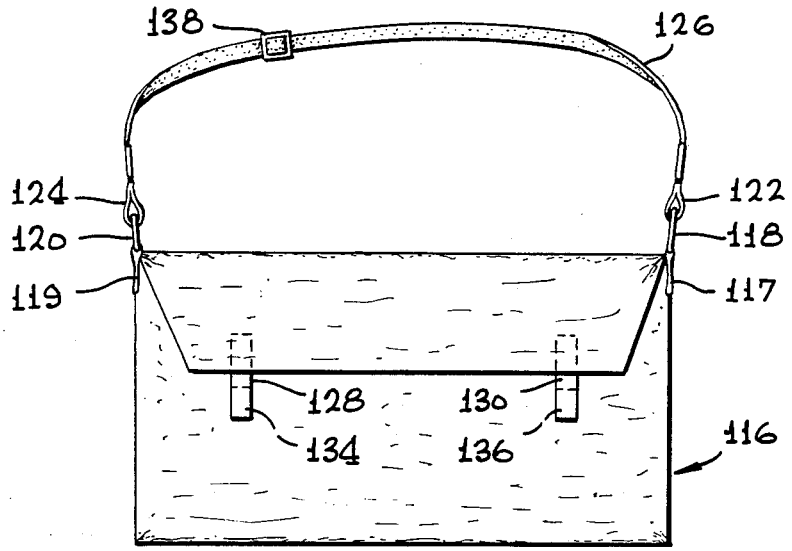
FIG. 5
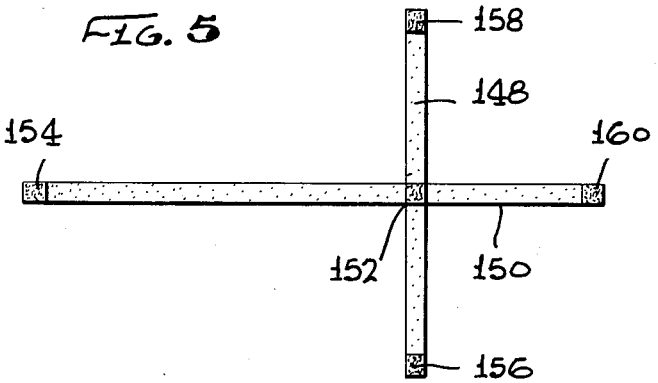
FIG. 6
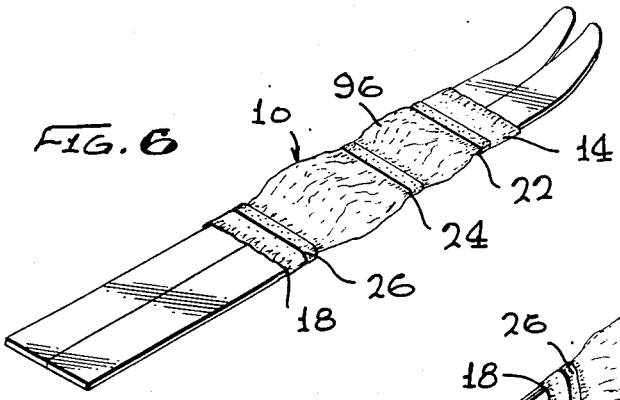
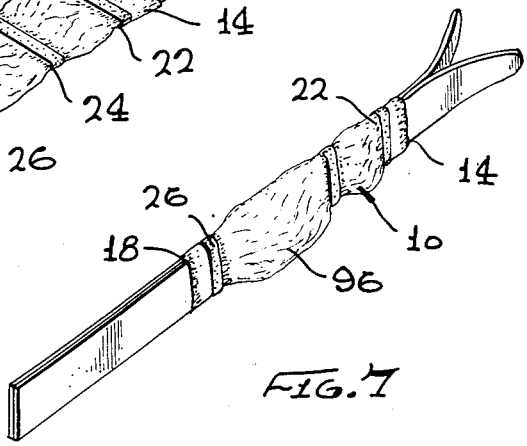
FIG. 7

PROTECTIVE COVER FOR SNOW SKI BINDINGS WITH CARRYING POUCH

BACKGROUND OF THE INVENTION

1. Field of the Invention

This invention is generally directed to a protective cover for snow ski bindings and more particularly to a waterproof cover that will hold and cover both ski bindings simultaneously.

2. Description of the Prior Art

The proper functioning of modern safety ski bindings is a necessary requirement for the safety of the sport. Therefore, all moveable parts should function smoothly and automatically release under a variety of potential dangerous conditions, thereby reducing the danger of injury to the skier. To this end, the function of the releasing parts should not exceed the safe value for which the bindings have been adjusted. This releasing action of the modern day bindings are substantially more complex and expensive than earlier simpler bindings and deserve more attention and maintenance.

During the ski season, skis are normally transported on automobiles in a ski rack on the top of the automobiles. This is a fully exposed condition where the danger of corrosion is high, especially if the roads have been salted to melt the snow and ice. Therefore the releasing action of the bindings may be impaired by rust, corrosion and harmful deposits and endanger the skier. To prevent this endangerment, the releasing mechanisms of the bindings must be protected in some manner while being transported and in storage.

There are several prior art covers available to protect snow ski bindings in bag-like sheaths. One of these is U.S. Pat. No. 4,055,287 to Champenois. This patent describes a vinyl sheath that encompasses each ski and binding separately. Champenois' protective covering consists merely of wrapping vinyl sheet around each ski binding and holding the sheet around the skis with straps containing velcro on each end. The present invention provides a more complete protective cover than Champenois in that each ski is held in place with a metal tab in addition to elastic being sewed in the outer layer of the protective cover providing a tight fitting cover on each end and the middle. This will prevent dirt and grime from seeping past the edge of the cover when transporting the skis in a ski rack on the top of an automobile.

Another arrangement for covering skis and bindings is presented in U.S. Pat. No. 3,851,689 and a C.I.P. U.S. Pat. No. 3,948,302 both by Kohls. Kohls describes a bag to completely cover both skis which incidently will cover the bindings. The structure of the present invention protection cover is completely different than that described by Kohls. The present invention contains two sheets making up the protective coat and has tight elastic bands on each end and the moddle of the cover.

SUMMARY OF THE INVENTION

It is a primary object of this invention to protect snow ski bindings from the effects of corrosion, dust, dirt and other harmful substances which can damage snow ski bindings either in storage or in transit.

It is another object of this invention to provide a convenient carrier to transport the skis and poles to and from the ski slopes.

It is yet another object of this invention to provide a pouch to store the protective cover while skiing on the slopes.

It is still another object of this invention to provide a red cross to signal for help if injured on the slopes.

Briefly, in accordance with the invention there is provided a protective cover fabricated from two layers of material for snow ski bindings attached to a pair of snow skis. The inner layer being waterproof and the outer layer being designed for rugged use. The protective cover also contains internal elastic at both ends and the middle to prevent dust, dirt and grime from entering the edges of the cover and reaching the bindings. There is also provided a substantial number of straps to insure the cover fits snugly over the bindings as well as straps to hold the poles. A sling is provided that forms, in conjunction with the protective cover, a carrier to transport the skis and poles to the slopes. In addition, a pouch is provided to store the protective cover and in conjunction with the sling, the pouch can be carried by the skier while skiing on the slopes. A further novel feature is a cloth red cross which can be attached to the inside of the cover and placed on the skis stuck upright in the snow to signal for help if someone is injured while skiing.

Other objects and advantages will become apparent from the following description and appended claims taken in conjunction with the accompanying drawings.

DESCRIPTION OF THE DRAWINGS

FIG. 3 is a front view of the protective cover pouch showing the strap attached thereto.

FIG. 5 is a flat view of the cloth red cross.

FIG. 6 is a perspective view of the snow skis placed side by side with the protective covering over the bindings.

FIG. 7 is a perspective view of the snow skis placed bottom to bottom with the protective covering over the bindings.

DETAILED DESCRIPTION OF THE INVENTION

Figure 1:
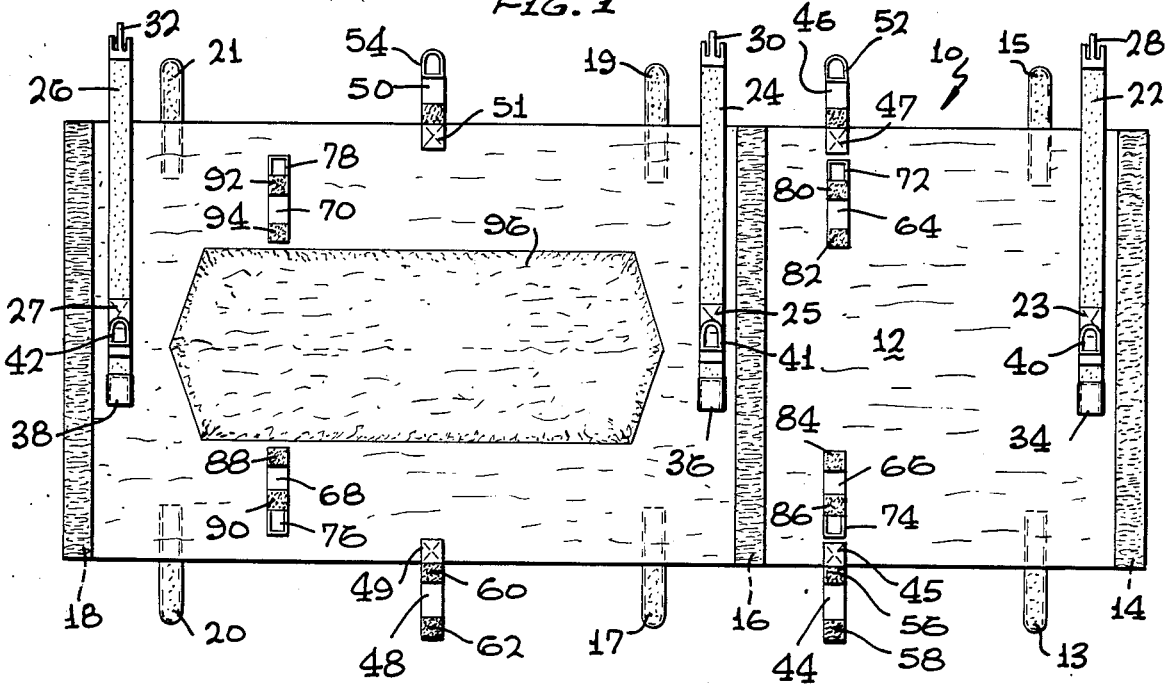
FIG. 1 is an outside view of the protective cover laying open on a flat surface.

Referring now to FIG. 1, there is shown according to the present invention the outside face of a protective cover for snow ski bindings generally indicated at 10. The protective cover 10 is constructed from flexible, waterproof, sheet material 12 generally having a rectangular shape. In the preferred embodiment, two layers are used, the outer layer being designed for rough usage and utilizing 400 denier pack cloth while the inner layer is nylon coated with Urathane for waterproofing.

Sheet 10 contains elastic webbing 14, 16 and 18. This webbing, which is shorter than the width of sheet 12, is sewn between the plies of sheet 12 and when wrapped around the skis provides a tight seal between the protective cover and the skis. The preferred embodiment of protective cover 10 contains covered metal tabs 13, 15, 17, 19, 20 and 21. These tabs are made out of a flexible metal that can be bent and folded over a substantial number of times without stress hardening and breaking. Also shown in FIG. 1 are main holding straps 22, 24 and 26 secured to sheet material 12 preferably by sewing at points 23, 25 and 27. These straps in the preferred embodiment are made from polypropylene webbing although any other material such as nylon, rayon, cotton or even plastic could be used. The straps have adjustable means to make them longer or shorter and are fitted with a side release buckle used to secure the strap ends of holding straps 22, 24 and 26. This buckle has three bars on the male ends described by 28, 30 and 32 which fits and snaps securely into the female ends described by 34, 36 and 38. A pressure of two fingers on each side of the side release buckle releases the buckle. A side release buckle that can be used in this embodiment is manufactured by Triglide ®, which is incorporated herein by reference. A complete description of this buckle and its operation can be found in U.S. Pat. No. 4,150,464. Straps 22, 24 and 26 also have attached thereto plastic rings 40, 41 and 42. The hooks on each end of the strap 126 (shown in FIG. 3) can be attached to plastic rings 40 and 42 when it is desired to transport the skis to and from the ski slopes. In addition to the main holding straps 22, 24 and 26, the protective cover has secondary holding straps 44, 46, 48 and 50 securd to sheet 12 preferably by sewing at points 45, 47, 49 and 51. These straps 44, 46, 48 and 50 are also made from polypropylene webbing in the preferred embodiment but are slightly smaller than the main holding straps 22, 24 and 26. Straps 46 and 50 also contain open rings 52 and 54 secured to one end of 46 and 50 respectively. A suitable fastener for covering snow ski bindings is disclosed in U.S. Pat. No. 3,555,630 to J. R. Wylde and assigned to Velcro S.A. a Corporation of Switzerland. This type of fastener sold under the trademark "Velcro" comprises opposing mating patches of fabric with interengagable hook and loop pile. Straps 44 and 48 contain Velcro patches designated by 56, 58, 60 and 62 attached to one side of the strap. Straps 44 and 48 fit through rings 52 and 54 and are held secure by the Velcro. The secondary straps hold the middle portion of sheet 12 to keep the center securely protected from the elements. Also shown in FIG. 1 are ski pole straps 64, 66, 68 and 70, secured to sheet 12 preferably by sewing, which can be used to hold the ski poles while in transit or while carrying the skis to and from the slopes. Ski pole straps 64, 66, 68 and 70 have plastic open rings 72, 74, 76 and 78 secured to one rod. Also straps 64, 66, 68 and 70 have Velcro patches attached to one side and designated as 80, 82, 84, 86, 88, 90, 92 and 94. The ski poles are placed on the strap and the strap is looped through the plastic ring and secured by Velcro. Also shown on FIG. 1 is a pleat 96. The pleat is a section of sheet 12 that provides more volume of cloth whereby the bindings can fit in the protective cover 10 without causing undue tightness and stress to the sheet material. The pleat 96 is made by cutting out the center of sheet 12 and sewing in extra cloth into the cut out.

Figure 2:
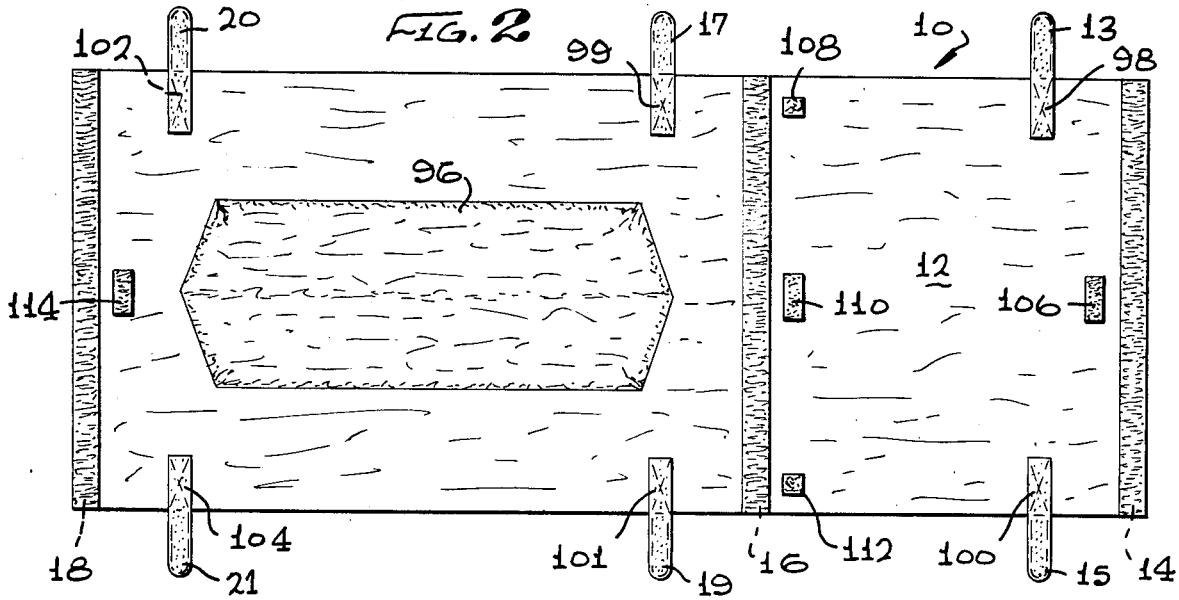
FIG. 2 is a inside view of the protective cover laying open on a flat surface.

Turning now to FIG. 2, there is seen the inside face of protection cover 10 and hence sheet 12. The metal tabs 13, 15, 17, 19, 20 and 21 are covered by the sheet material and the covering is attached, preferably sewn at 98, 100, 101, 102 and 104 to the outside of sheet 12. On the outside of sheet 12, Velcro patches are attached at 106, 108, 110, 112 and 114. These patches which are secured to the outside of sheet 12 are used to display an emergency red cross made from cloth material. The red cross and its operation will be explained in detail later in this specification.

Figure 4:
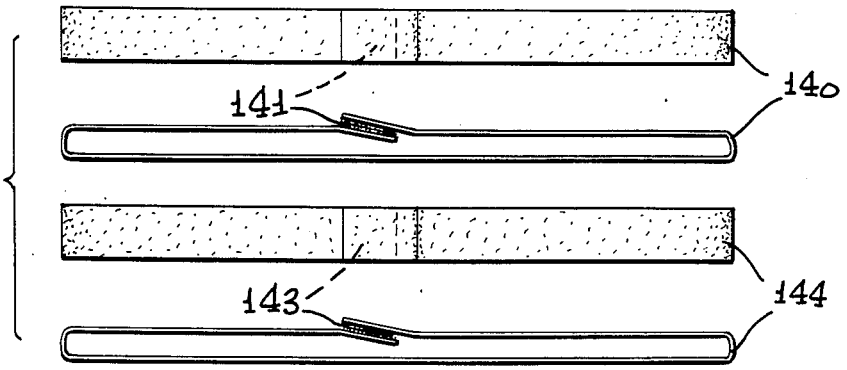
FIG. 4 is a side and top view of straps to hold ski brakes secure.

Turning to FIG. 3, there is seen a pouch 116 for storing the protective cover 10, the straps in FIG. 4 and the cross in FIG. 5. The pouch 116 which in the preferred embodiment is made from the same material as that discussed for sheet 12, has two triangular plastic loops 118 and 120 attached to each end of cover of pouch 116 by straps 117 and 119. These straps are made from polypropylene webbing and are preferably sewn to the pouch material. The loops 118 and 120 are thereby attached to snap hooks 122 and 124 which are in turn all attached to the end of strap 126. Pouch 116 has two holding straps 128 and 130 that are sewn to the inside of pouch flap 132. The ends of straps 128 and 130 are Velcro patches 134 and 136 which communicate with a similar Velcro patch attached to the pouch 116. This prevents the contents of the pouch 116 from falling out. As shown in FIG. 3, strap 126 is configured to be used as a shoulder strap to carry the pouch 116. However, as previously stated, strap 126 may also be used when tranporting skis and bindings to and from the slopes by fastening strap hooks 118 and 124 to loops 40 and 42 in FIG. 1. In addition, strap 126 may be adjusted by adjusting means 138.

FIG. 4 shows a top view and side view of straps 140 and 144 that are used to hold in a closed position braking means (not shown) if utilized, on the ski bindings. If braking means are used, the device is a spring loaded mechanism that is released when the ski is released from the boot to prevent the ski from becoming a projectile sliding down the slopes. When the boots are not in the skis the braking means is released and would pierce the binding cover if not restrained. Straps 140 and 144 made from polypropylene or nylon webbing are wrapped around the braking means to hold the mechanism in a closed position. Velcro patches 141 and 143 provide the securing means on straps 14 and 144.

FIG. 5 shows two pieces of narrow red nylon material 148 and 150 attached at 152 preferably by sewing. The webbing 148 and 150 has Velcro patches at points 154, 156, 158 and 160. These patches, in an emergency, are attached to corresponding Velcro patches 106, 108, 112 and 114 respectively shown in FIG. 2. In an emergency, the two skis are placed vertical in the snow sufficiently far apart to allow metal tabs 14, 16, 18 and 20 to be bent around the ski and hold the protective cover sheet 12 taut. The red cross would therefore be displayed to others on the slopes who would summon help.

FIG. 6 is a perspective view of the protective cover placed on snow skis in a side by side position as would be placed in one type of car top carrier.

FIG. 7 is a perspective view of the protective cover placed on snow skis in a back to back position as would be placed in another type of car top carrier.

The operation of the protective cover is provided by laying the exterior face of sheet 12 in FIG. 2 on a flat surface. This will expose the interior face of sheet 12 as shown in FIG. 1. The skis (not shown) are placed parallel to each other on the outer edge of sheet 12 perpendicular to tabs 13, 15, 17, 19, 20 and 21. The rear ski bindings must be able to fit into the pleat 96. Tabs 13, 15, 17, 19, 20 and 21 are thereby wrapped around and bent over each ski. The skis are folded toward each other until they are enclosed by protective cover 12. Secondary, holding straps 44, 46, 48 and 50 are secured first. Thereafter, primary holding straps 22, 24 and 26 are secured. Depending on how many folds are made, the skis may be used as in the configuration of FIG. 6 or FIG. 7. In either case, the protective cover will provide excellent resistance from an adverse environment.

Thus, it is apparent that there has been provided, in accordance with the invention, a protective cover for snow ski bindings that fully satisfies the objective, aims and advantages set forth above. While the invention has been described in conjunction with specific embodiments thereof, it is evident that may alternatives, modifications, and variations will be apparent to those skilled in the art in light of the aforegoing description. Accordingly, it is intended to embrace all such alternatives, modifications, and variations which fall within the spirit and scope of the appended claims.

What is claimed is:

1. In combination, a protective cover for snow ski bindings attached to a pair of skis and a carrying pouch comprising:

two layers of waterproof, rectangular flexible sheet material for forming said cover in an envelope around said bindings;

an accommodating pleat located in said cover;

adjustable straps attached to said sheet material with fastening means for securing said envelope around said bindings;

a rectangular carrying pouch with a strap attached thereto for storing said cover;

adjustable straps attached to said sheet material with fastening means for securing said envelope around said bindings.

2. The combination as described in claim 1 wherein said cover may be arranged in a rectangular folded configuration.

3. The combination as described in claim 1 wherein said accommodating pleat is located in a position in said cover to receive the rear portion of said ski bindings.

4. The combination as described in claim 1 wherein said cover contains at least three elastic bands sewn between said layers and attached in a stretched condition to the shorter edges and middle between said short edges of said rectangular cover, said elastic bands arranged to wrap around said pair of skis.

5. The combination as described in claim 1 wherein said cover has attached thereto at least six flexible metal tabs designed to fold over and hold said pair of skis when said pair of skis are placed in said cover.

6. The combination as described in claim 1 wherein said fastening means is of the hook and loop type.

7. The combination as described in claims 1 wherein said fastening means is a lock type side release plastic buckle.

8. The combination as described in claim 1 wherein said cover contains holding means for ski poles comprising at least four straps secured to said cover by sewing on one end and having fastening means of the hook and loop type on the other end.

9. The combination as described in claim 1 wherein said waterproof flexible sheet material is made with two layers, the outside layer being 400 denier pack cloth and the inside layer being nylon cloth coated with urethane.

10. The combination as described in claim 1 wherein said straps are made from polypropylene webbing.

11. In combination, a protective cover for snow ski bindings attached to a pair of skis and a carrying pouch comprising:

two layers of waterproof, rectangular sheet material for forming said cover in an envelope around said bindings, said cover containing at least three elastic bands attached in a stretched condition to the shorter edges and the middle between the short edges by being sewn between said layers of said rectangular cover, said elastic bands arranged to wrap around said skis, said cover containing at least six flexible metal tabs attached to said cover and designed to fold over and hold said skis when said skis are placed on said cover;

an accommodating pleat located in both layers of said cover wherein said accommodating pleat is located to receive the rear portion of said ski bindings;

adjustable straps attached to said sheet material with fastening means for securing said envelope around said bindings wherein said fastening means are side release lock type buckles;

a rectangular carrying pouch with a strap attached thereto for storing and transporting said protective cover.

12. The combination as described in claim 11 wherein said fastenting means is of the hook and loop type.

13. The combination as described in claim 11 wherein said cover contains holding means for ski poles of at least four straps secured to said cover by sewing on one end, with fastening means of the hook and loop type on the other end.

14. The combination as described in claim 11 wherein said waterproof sheet material is made with two layers, the outside layer being 400 denier pack cloth and the inside layer being nylon cloth coated with Urethane.

15. The combination as described in claim 11 wherein said straps are made from polypropylene webbing.

16. A method of providing a protective cover for snow ski bindings attached to snow skis while in transit or in storage in combination with a carrying pouch comprising:

providing waterproof flexible material in a rectangular configuration made in two layers, the outer layer being 400 denier pack cloth and the inner layer being nylon cloth covered with a Urethane coating;

fabricating a rectangular cover with a pleat in the portion that accepts the rear half of the ski bindings to provide extra material therein;

providing sealing means around each end and middle of the short side of said rectangular cover by sewing elastic bands in a stretched condition between said layers at each end and middle of said cover;

providing at least six flexible metal tabs, said metal tabs being attached on one end to said cover;

laying said skis in the middle of said cover such that the skis are parallel to the longest side of said rectangular cover;

bending flexible metal tabs attached to the inside of said cover over said skis;

providing polypropylene holding straps with fastening means wrapped around said ski bindings to hold ski braking means in a closed position;

wrapping said cover around both ski bindings such that the rear portion of said bindings fit in said pleat;

binding said cover around said skis by polypropylene straps attached to said cover with fastening means on each end whereby said fastening means are side release lock type plastic buckles;

fastening said ends of said straps whereby said cover fits snugly around said bindings;

providing a carrying pouch with polypropylene straps attached thereto for transporting said cover whereby said straps may be placed over a shoulder or around a waist;

providing polypropylene straps attached to said cover with fastening means to hold ski poles.

17. In combination, a protective cover for snow ski bindings attached to a pair of skis and a carrying pouch comprising:

two layers of waterproof flexible sheet material in a rectangular configuration for forming said flexible cover in an envelope around said bindings, the outer layer utilizing 400 denier pack cloth, the inner layer utilizing nylon cloth coated with urethane, said cover containing at least three elastic bands attached in a stretched condition to the shorter sides and the middle between said shorter sides of said rectangular cover by being sewn between said two layers, said elastic bands arranged to wrap around said ski bindings attached to said skis, at least six flexible metal tabs attached on one end of said tabs to said cover designed to fold over and hold said pair of skis when said skis are placed in said cover;

an accommodating pleat located in both layers of said cover wherein said accommodating pleat is positioned to receive the rear portion of said ski bindings;

holding straps with fastening means wrapped around said ski bindings to hold braking means in a closed position;

adjustable straps with fastening means for securing said envelope around said bindings wherein said adjustable straps made from polypropylene webbing and said fastening means are side release lock type plastic buckles;

a rectangular carrying pouch with straps attached thereto for storing and transporting said protective cover wherein said straps may be placed over a shoulder or around a waist;

holding straps with fastening means wrapped around said ski bindings to hold braking means in a closed position;

holding means for ski poles of at least four straps secured to said cover by sewing on one end, with fastening means of the hook and loop type on the other end; bands arranged to wrap around said ski bindings attached to said skis, at least six flexible metal tabs attached on one end of said tabs to said cover designed to fold over and hold said pair of skis when said skis are placed in said cover;

an accommodating pleat located in both layers of said cover wherein said accommodating pleat is positioned to receive the rear portion of said ski bindings;

holding straps with fastening means wrapped around said ski bindings to hold braking means in a closed position;

adjustable straps with fastening means for securing said envelope around said bindings wherein said adjustable straps made from polypropylene webbing and said fastening means are side release lock type plastic buckles;

a rectangular carrying pouch with straps attached thereto for storing and transporting said protective cover wherein said straps may be placed over a shoulder or around a waist;

holding straps with fastening means wrapped around said ski bindings to hold braking means in a closed position;

holding means for ski poles of at least four straps secured to said cover by sewing on one end, with fastening means of the hook and loop type on the other end.

* * * * *